United States Patent [19]

Sparshott et al.

[11] Patent Number: 4,828,409

[45] Date of Patent: May 9, 1989

[54] PRINT HEAD

[75] Inventors: John Sparshott; Stephen Butler, both of Wokingham; Richard Bowsher, Reading, all of United Kingdom

[73] Assignee: Russet Instruments PLC, Reading, England

[21] Appl. No.: 59,503

[22] Filed: Jun. 8, 1987

[30] Foreign Application Priority Data

Jun. 11, 1986 [GB] United Kingdom ..... 8614217

[51] Int. Cl.[4] ..... B41J 3/12

[52] U.S. Cl. ..... 400/124; 101/93.05; 335/274

[58] Field of Search ..... 400/124; 101/93.05; 335/274, 275

[56] References Cited

U.S. PATENT DOCUMENTS

| | | | |
|---|---|---|---|
| 4,084,678 | 4/1978 | Reier | 400/124 |
| 4,136,978 | 1/1979 | Bellinger | 101/93.05 X |
| 4,230,038 | 10/1980 | Hebert | 101/93.05 |
| 4,230,412 | 10/1980 | Hebert | 400/124 |
| 4,367,962 | 1/1983 | Garboardi | 400/124 |
| 4,403,875 | 9/1983 | Asano | 101/93.05 X |

FOREIGN PATENT DOCUMENTS

| | | | |
|---|---|---|---|
| 0139217 | 9/1984 | European Pat. Off. | 400/124 |
| 1598882 | 4/1977 | United Kingdom | 400/124 |
| 2015931 | 3/1979 | United Kingdom | 400/124 |

*Primary Examiner*—Paul T. Sewell

*Attorney, Agent, or Firm*—Parmelee, Bollinger & Bramblett

[57] ABSTRACT

A print head for a dot matrix printer comprises a housing (1) containing a number of actuators (2) driving a corresponding number of print wires (6). Each actuator (2) includes an actuating coil (11) wound around a yoke (10) fixed to the housing (1) and a pivotable armature (13) adjacent the yoke (10). The armature has one end pivotally connected to the housing by a hinge of rubber or rubber-like elastomeric material (26) and has its other end engaging the head of a print wire (6) so that, upon application of current to the actuating coil the pivotable armature (13) is attracted towards the yoke (10) and pivots about its one end causing its other end to drive the printwire (6) forwards. Preferably the pivoting armature (13) is formed by two separate parts, a soft iron pole piece (20) and an actuating finger (21). Preferably they are connected together by both a spot weld (22) and an adhesive. Preferably each actuator (2) also includes an adjusting screw (16) which bears against a damper (15). The dampers are formed by a number of side-by-side blocks (15) of rubber or rubber-like elastomeric material with the bocks (15) being joined to one another by a thin flexible membrane (33).

17 Claims, 3 Drawing Sheets

PRINT HEAD

BACKGROUND OF THE INVENTION

Dot matrix printers have been used in a wide variety of applications and, in particular, have been used to provide a printed output from a computer. Dot matrix printers typically fall into two basic types, a high speed type and a high quality type. The high speed type usually prints characters using a seven high by five wide matrix of dots and the individual dots forming each character are readily resolvable by the naked eye of the observer. This type of printer tends to be used to print information very quickly in draft form. The high quality type produces a high quality font in which the individual dots are not resolvable with the naked eye and the output appears substantially indistiguishable from a typewritten or printed document. Typically such a print head uses an eighteen high by thirty-six wide matrix of dots.

For both of these disparate uses the basic limitation on the printing speed is the repetition rate at which each of the print wires of the print head is driven forwards to urge an inked ribbon into contact with paper to be printed. Many attempts have been made to increase this repetition rate but, at present, the maximum repetition rate that is currently obtainable is around 1500 Hz with a printing needle stroke of around 0.25 mm.

SUMMARY OF THE INVENTION

According to this invention a print head for a dot matrix printer comprises a housing containing a number of actuators driving a corresponding number of print wires, each actuator including an actuating coil wound around a yoke fixed to the housing and a pivotable armature adjacent the yoke, the armature having one end pivotally connected to the housing by a hinge of rubber or rubber-like elastomeric material and having its other end engaging the head of a print wire so that, upon application of current to the actuating coil the pivotable armature is attracted towards the yoke and pivots about its one end causing its other end to drive the printwire forwards.

In the past moving armatures have merely been restrained to move within guides and have not been provided with a hinge of any kind. However, we have found that by providing a hinge of rubber or rubber-like elastomeric material between the one end of the armature and the housing we have been able to damp out unwanted lateral vibrations of the armature whilst, at the same time not significantly restricting the pivoting movement of the armature. Thus the rubber or rubber-like hinge improves the operation of the armature head whilst, at the same time, helping to damp its movement with the result that the repetition rate of the actuator is increased.

Preferably the pivoting armature is formed by two separate parts, a soft iron pole piece located at the one end of the armature to cooperate with the yoke and an actuating finger extending away from the one end of the armature and engaging the head of the print wire. Preferably the actuating finger is connected to the pole piece by both a spot weld and an adhesive. It is further preferred that the actuating finger is channel-shaped in cross-section and made of hardened material. By this composite construction of the armature a considerable reduction in rotational inertia is achieved and the properties of each part of the armature are optimised so that, the pole piece is annealed to provide the preferred magnetic properties whilst the actuating finger is hardened to resist the fatigue loadings imposed on it and to provide the best strength to weight ratio. However, conventional joining techniques such as welding or brazing would reduce the temper of the material forming the actuating finger and so reduce its ability to resist fatigue loadings. Also a simple spot welded connection which would do little to alter the intrinsic properties of the actuating finger would lead to stress concentrations around the edges of the spot weld which, in turn, would lead to failure. The combination of a spot weld and an adhesive provides the optimum performance in that the adhesive eliminates stress concentrations in the joint between the pole piece and the actuating finger whilst not degrading the material properties, and the spot weld prevents any creep of the adhesive at high operating temperatures.

Preferably each actuator includes a piece of resilient material arranged between the pivotable armature and the housing to damp the return movement of the armature. Conventionally dampers in print heads have the form of an 0-ring or a disc of rubber or rubber-like elastomeric material. Preferably each actuator also includes an adjusting screw which bears against a damper to adjust the rest position of the pivotable armature to allow the operating position of each print wire to be set up. In this case it is much preferred that the dampers are formed by a number of side-by-side blocks of rubber or rubber-like elastomeric material arranged to cooperate with the adjusting screws and pivotable armatures of adjacent actuators with the blocks being joined to one another by a thin flexible membrane which permits the adjusting screws associated with each actuator to be adjusted without upsetting the rest position of its neighbours. This was one of the difficulties with dampers in conventional print heads.

It is especially preferred that the print head includes the combination of the above features and we have found that when the printhead does include this combination of features of the repetition rate exceeds 2,400 Hz which is a substantial improvement over the conventional maximum repetition rate of 1,500 Hz.

The hinge of rubber or rubber-like elastomeric material may be formed by a moulding which receives the one end of the pivotable armature and is fixed to the housing of the print head, alternatively, the one end of the pivotable armature may be bedded in a curable elastomer which is subsequently cured. Preferably the rubber or rubber-like elastomeric material is a silicone rubber having a Shore hardness of around 50. The elastomeric material is preferably capable of withstanding temperatures of at least 150° C. without deterioration.

Preferably the actuators are arranged in a circular configuration around a circular portion of the housing with the one ends of the pivotable armatures arranged towards the periphery of the circular portion and their print wires towards the centre of the circular portion. With this arrangement the damping blocks are also preferably arranged generally radially around a circular membrane. It is preferred that the moving armatures are generally T-shaped with the one end being formed by the head of the T and the actuating finger being formed by the leg of the T. It is also preferred that the leg of the T tapers from its head to its foot. Preferably it is the extremities of the head of the T which are held by the elastomeric hinge.

When a print head in accordance with this invention is used as a high speed printer it typically includes only seven actuators and print wires but when used for high quality printing it typically includes eighteen actuators and print wires.

BRIEF DESCRIPTION OF THE DRAWINGS

A particular example of a print head in accordance with this invention will now be described with reference to the accompanying drawings, in which.

DESCRIPTION OF PREFERRED EXAMPLE

Figure 1:
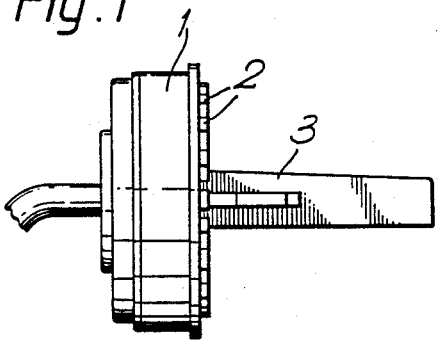
FIG. 1 is a side elevation.
Figure 2:
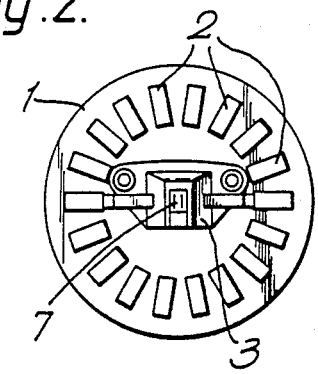
FIG. 2 is a front elevation.
Figure 3:
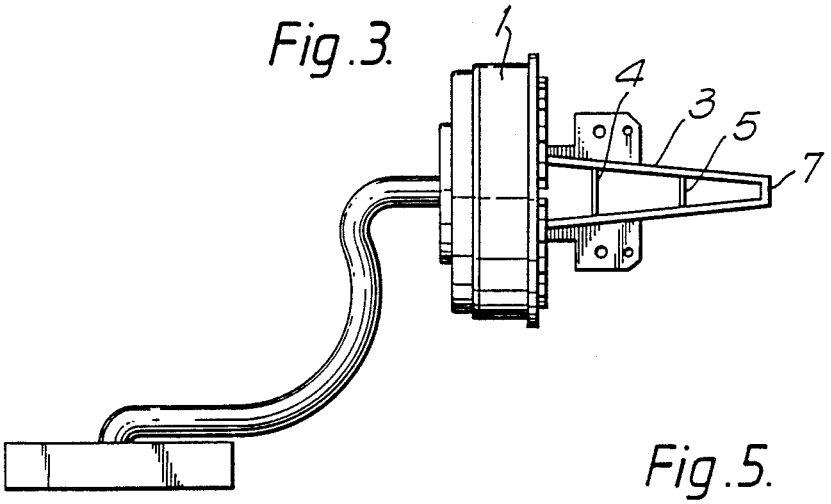
FIG. 3 is an under plan.
Figure 5:
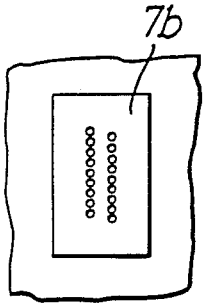
FIG. 5 is a front elevation of a second version of the noseguide drawn to an enlarged scale.
Figure 4:
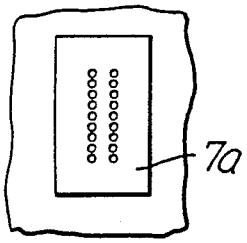
FIG. 4 is a front elevation of a first version of the noseguide drawn to an enlarged scale.
Figure 6:
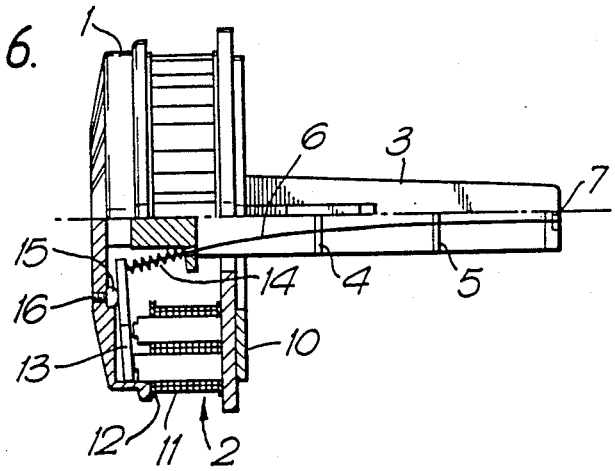
FIG. 6 is a partially sectioned side elevation.

A print head in accordance with this invention includes a housing having a cylindrical part 1 containing eighteen actuators 2, shown diagramatically in FIG. 2, and a nosepiece 3. The nosepiece includes guides 4 and 5 which support print wires 6 shown in FIG. 6 and a nose guide 7. The nose guide 7 is shown in more detail in FIGS. 4 and 5 and in the first example shown in FIG. 4 the guide 7*a* has the print wires 18 arranged in two adjacent upright columns with the wires in each column being arranged at the same height. Typically the print wires are 0.3 mm in diameter and are spaced at a pitch of 0.353 mm. In the second example shown in FIG. 5 the guide 7*b* includes two upright columns of print wires with the same diameter print wires arranged at the same spacing in each column as the first example but with the right hand side column, as seen in FIG. 5, lower than the left hand column by a distance of half of the pitch of the wires. This arrangement enables the dots produced by print wires from each column to be staggered in relation to one another to produce a character with greater definition.

Each actuator 2 includes a U-shaped iron yoke 10 which carries a coil 11 wrapped on a former 12. The yoke 10 is fixed to the cylindrical part 1 of the housing. The actuator also includes a pivotable armature 13, the construction of which will be described in detail subsequently, one end of which is pivotably connected to the part 1 of the housing adjacent one of the pole pieces of the yoke 10 and the free end of which is adjacent the centre of the part 1 of the housing and which engages the head of the print wire 6. A light return spring 14 is arranged and acts between the free end of the pivotable armature 13 and a portion of the part 1 of the housing and urges the print wire and hence the moving armature 13 away from the yoke 10 against a damper pad 15 supported by an adjusting screw 16.

Figure 7:
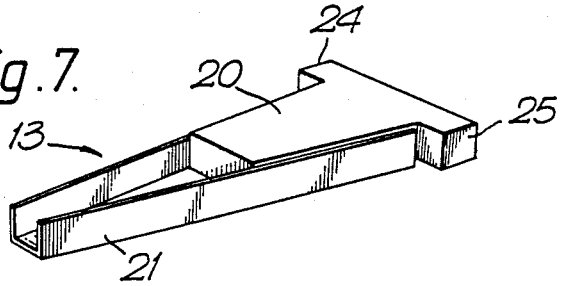
FIG. 7 is a perspective view from underneath and one side of a pivotable armature drawn to a much enlarged scale.

In use when an actuating current is applied to the coil 11 the pivotable armature 13 is attracted towards both pole pieces of the yoke 10 and as it pivots about its one end the free end of the armature 13 moves the print wire 6 towards the right as seen in FIG. 7 to cause the end of the print wire 6 to move forwards through the nose guide 7 to urge an inked ribbon against the paper to be printed. Upon ceasation of the actuating current the return spring 14 returns the moving armature 13 into its rest position shown in FIG. 6. The damper 15 absorbs the rebound of the moving armature 13 and the adjusting screw 16 is used to set the rest position of the moving armature and hence of the print wire 6.

Figure 8:
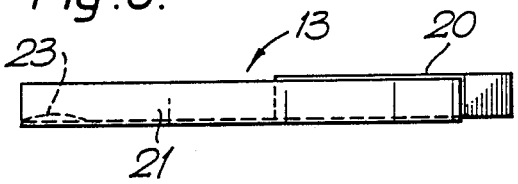
FIG. 8 is a side elevation of the moving armature.
Figure 9:
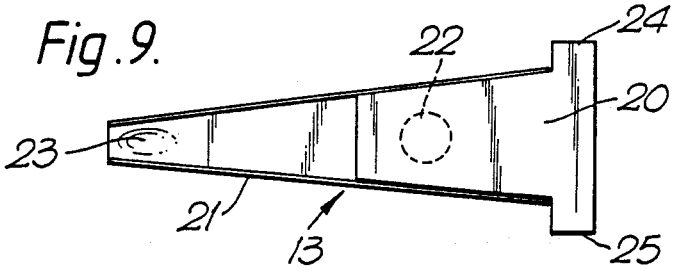
FIG. 9 is an underplan of the moving armature.

The moving armature 13 is shown in more detail in FIGS. 7, 8 and 9. The pivotable armature 13 is generally T-shaped with the limb of the T tapering from its head to its foot. The moving armature 13 is formed from two pieces, an iron pole piece 20 which is annealed so that it is easily magnetisable but has a low remnance and a channel-shaped actuating finger 21 which is made of hardened steel. The actuating finger 21 is fixed to the pole piece 20 by a spot weld 22 shown in FIG. 9 and by the use of a heat cured epoxy resin adhesive covering the entire area of contact on the base and sides of the channel-shaped actuating finger. The free end of the channel-shaped actuating finger 21 includes a dimple 23 to engage the head of the print wire 6.

Figure 10:
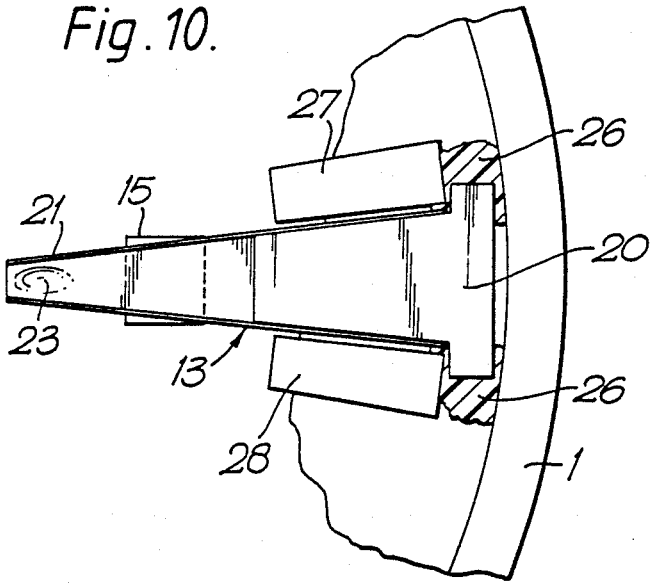
FIG. 10 is a front elevation of part of the print head showing the mounting of the moving armature in the housing.

Ends 24 and 25 of the T-shaped pole piece 20 are pivotally connected to the part 1 of the housing by, in this example, being bedded in a curable silicone rubber 26 as shown in FIG. 10. The armature 13 is located between guides 27 and 28. The silicone rubber 26, once cured, allows the armature 13 to pivot about the portions 24 and 25 when the pole piece 20 is attracted by the yoke 10 but prevents lateral oscillations of the armature 13 between the guides 27 and 28 so ensuring that the print wire 6 is moved correctly upon actuation of the coil 11. We have found that a curable silicone rubber manufactured by Dow Corning and marketed as "Flurosilicone sealant" works satisfactorily.

Figure 11:
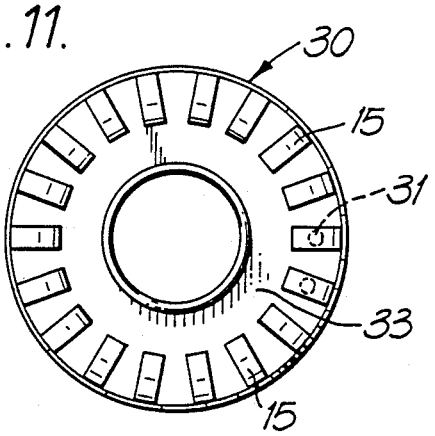
FIG. 11 is a front elevation of a damper disc.
Figure 12:
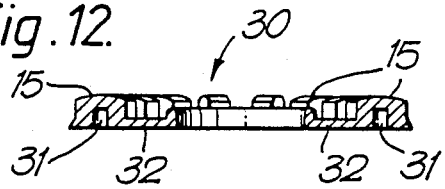
FIG. 12 is a dimetral section through the damper disc.

The dampers 15 for each actuator are preferably formed on a single damping disc 30 shown in FIGS. 11 and 12. The damping disc includes a number of blocks 15 each of which has a recess 31 to receive its corresponding adjusting screw 16 and the blocks are all joined together by a thin flexible membrane 32. The membrane 32 preferably has a thickness of 0.5 mm and it is sufficiently flexible for adjustment of one of the adjusting screws 16 to move the position of its corresponding block 15 not to affect the position of the neighbouring blocks 15 and so affect the rest position of adjacent armatures 13.

We claim:

1. A print head for a dot matrix printer comprising a housing, a plurality of actuators contained in said housing, a corresponding plurality of print wires, each said print wire including a head end and a distal end and being driven by its respective actuator, each said actuator including a yoke fixed to said housing, an actuating coil wound around said yoke, a pivotable armature adjacent said yoke, said armature having first and second ends, and comprises two separate parts: a soft iron pole piece located at said first end of said armature to cooperate with said yoke, and an actuating finger at said second end of said armature engaging said head of its respective print wire, said actuating finger is connected to said pole piece by both a spot weld and an adhesive, and a hinge of elastomeric material pivotally connecting said first end of said armature to said housing, said second end of said armature engaging said head of its respective print wire whereby, upon application of a current to said actuating coil, said pivotable armature is attracted towards said yoke and pivots about its first end causing its second end to drive its respective print wire forward.

2. A print head for a dot matrix printer comprising a housing, a plurality of actuators contained within said housing, a corresponding plurality of print wires, each said print wire including a head end and a distal end and each being driven by its respective actuator, each said actuator including a yoke fixed to said housing, an actuating coil wound around said yoke, and a pivotable armature adjacent said yoke, said armature having first and second ends, said first end being pivotally connected to said housing and said second end engaging said head of its respective print wire whereby, upon application of a current to said actuating coil, said pivotable armature is attracted towards said yoke and pivots about its first end causing its second end to drive its respective print wire forwards, each said pivoting armature being formed by two-separate parts, a soft ion pole piece. located at said first end of said armature to cooperate with said yoke and an actuating finger extending away from said first end of said armature and engaging said head of its respective print wire, said actuating finger being connected to said pole piece by both a spot weld and adhesive.

3. The print head of claim 2, wherein said actuating finger is channel-shaped in cross-section and is made of hardened metal.

4. The print head of claim 2, wherein said armature is connected to said housing by a hinge of elastomeric material.

5. The print head of claim 2, wherein each acutator includes a damper formed of resilient material between said pivotable armature and said housing to damp return movement of said armature.

6. The print head of claim 5, wherein each actuator also includes an adjusting screw, said adjusting screw bearing against said damper to adjust the rest position of said pivotable armature to allow an operating position of each said print wire to be set up.

7. The print head of claim 6, wherein said dampers are formed by a corresponding plurality of side-by-side blocks of elastomeric material arranged to cooperate with said adjusting screws and pivotable armatures of adjacent actuators and a flexible membrane, said flexible membrane joining said blocks to one another and permitting adjustment of said adjusting screws associated with each actuator without upsetting of said rest position of its neighbours.

8. The print head of claim 2, wherein said actuators are arranged in a circular configuration with said first ends of said pivotable armatures arranged towards the periphery and said print wires arranged towards the centre.

9. The print head of claim 2, wherein said moving armatures are T-shaped with said first end being formed by the head of the T and said second end being formed by the leg of the T.

10. The print head of claim 9, wherein said leg of said T tapers from its head to its foot.

11. The print head for a dot matrix printer comprising a housing, a plurality of actuators contained within said housing, a corresponding plurality of print wires, each said print wire including a head end and a distal end and each being driven by its respective actuator, each said actuator including a yoke fixed to said housing, an actuating coil wound around said yoke, and a pivotable armature adjacent said yoke, said armature having first and second ends, said first end being pivotally connected to said housing and said second end engaging said head of its respective print wire, said pivoting armature is formed by two separate parts; a soft iron pole piece located at said first end of said armature to cooperate with said yoke, and an actuating finger at said second end of said armature and engaging said head of said print wire, said actuating finger is connected to said pole piece by both a spot weld and an adhesive, whereby upon application of current to said actuating coil said pivotable armature is attracted towards said yoke and pivots about its first end causing its second end to drive its respective print wire forwards, each actuator also including an adjusting screw mounted in said housing, and a damper formed of resilient material arranged between said pivotable armature and said adjusting screw to damp return movement of said armature, said dampers being formed by a corresponding plurality of side-by-side blocks of elastomeric material and a flexible membrane, said membrane joining said blocks one to another and permitting said adjusting screws associated with each respective actuator to be adjusted without upsetting the rest position of its neighbours.

12. The print head of claim 11, wherein said actuating finger is channel-shaped in cross section and made of hardened metal.

13. A print head for a dot matrix printer comprising: a housing; a plurality of actuators contained in said housing; a corresponding plurality of print wires, each including a head end and a distal end and being driven by its respective actuators; each said actuator including a yoke fixed to said housing; an actuating coil wound around said yoke; a pivotable armature adjacent said yoke, said armature having first and second ends and being formed by two separate parts: a soft iron pole piece located at said first end of said armature to cooperate with said yoke and an actuating finger extending away from said first end of said armature; a hinge of elastomeric material, said hinge pivotally connecting said first end of said armature to said housing and said actuating finger engaging said head of its respective print wire, said actuating finger being connected to said pole piece by a spot weld and an adhesive: an adjusting screw mounted in said housing; and, a damper formed of resilient material arranged between said pivotable armature and said adjusting screw to damp return movement of said armature, said dampers being formed by a corresponding plurality of side-by-side blocks of elastomeric material and a flexible membrane, said flexible membrane joining said blocks to one another and permitting said adjusting screw associated with each respective actuator to be adjusted without upsetting the rest position of its neighbours, said print being arranged whereby, said application of current to said actuating coil, said pivotable armature is attracted toward said yoke and pivots abouts its first end causing its second end to drive its respective print wire forwards.

14. The print head of claim 13, wherein said moving armatures are generally T-shaped with said first end being formed by the head of the T and said second end being formed by the leg of the T.

15. The print head of claim 14, wherein said leg of said T tapers from its head to its foot.

16. The print head of claim 13, wherein said actuators are arranged in a circular configuration with said first ends of said pivotable armatures arranged towards the periphery and said print wires arranged towards the centre.

17. The print head of claim 16, wherein said membrane is circular and said damping blocks are arranged generally radially around said circular membrane.

* * * * *